US005641329A

United States Patent [19]

Lander et al.

[11] Patent Number: 5,641,329

[45] Date of Patent: Jun. 24, 1997

[54] USE OF DILUENTS FOR STABILIZING HYDROCARBON FUELS

[75] Inventors: Herbert R. Lander, Westlake Village; Robert E. Schnurstein, Northridge, both of Calif.

[73] Assignee: Rockwell International Corporation, Seal Beach, Calif.

[21] Appl. No.: 489,659

[22] Filed: Jun. 12, 1995

Related U.S. Application Data

[63] Continuation of Ser. No. 197,909, Feb. 17, 1994, abandoned.

[51] Int. Cl.[6] ..... C10L 1/04

[52] U.S. Cl. ..... 44/300; 585/14

[58] Field of Search ..... 44/300; 585/14

[56] References Cited

U.S. PATENT DOCUMENTS

| | | | |
|---|---|---|---|
| 4,028,066 | 6/1977 | Burdette et al. | 585/14 |
| 4,099,931 | 7/1978 | Bryant et al. | 585/14 |
| 4,242,529 | 12/1980 | Schneider et al. | 585/14 |
| 4,286,109 | 8/1981 | Norton et al. | 585/14 |
| 4,320,238 | 3/1982 | Norton et al. | 585/14 |
| 4,367,351 | 1/1983 | Fisher et al. | 585/14 |
| 4,645,585 | 2/1987 | White | 585/14 |
| 5,151,171 | 9/1992 | Spadaccini et al. | 208/48 |
| 5,176,814 | 1/1993 | Spadaccini et al. | 208/48 Q |
| 5,232,672 | 8/1993 | Spadaccini et al. | 208/48 Q |
| 5,236,152 | 8/1993 | Lander et al. | 244/117 A |

*Primary Examiner*—Jacqueline V. Howard

*Attorney, Agent, or Firm*—George A. Montanye; Harry B. Field; Steve E. Kahm

[57] ABSTRACT

The use of hydrocarbon fuels for cooling hypersonic aircraft and missile structures and engines is accomplished by passing fuel through cooling channels in the vehicle. A multicomponent hydrocarbon fuel having a pyrolyzing component which cracks in a supercritical temperature range (above 900° F.) and thus absorbs heat is used in combination with a diluent fuel or fuel component which reduces the rate at which cracked hydrocarbons recombine in the cooling channels, thus causing coking which can clog cooling channels and also release heat to the structure to be cooled. The cracked fuel having absorbed heat and remaining in it's cracked state is in a condition to burn more quickly and energetically in the combustion chamber along with the hot diluent fuel, thus providing an efficient use of the heat absorbed in the cooling process and increasing the performance of the vehicle.

20 Claims, No Drawings

USE OF DILUENTS FOR STABILIZING HYDROCARBON FUELS

This is a continuation of application Ser. No. 08/197,909 filed on Feb. 17, 1994, now abandoned.

BACKGROUND OF THE INVENTION

1. Field of the Invention

This invention relates to hydrocarbon fuels for high speed aircraft and missiles where the fuel is used in cooling the vehicle and the engine.

2. Description of the Related Art

The state of the art of using hydrocarbon jet fuels to cool engine or vehicle components is much as it has been since the development of the gas turbine engine for aviation. The fuel is primarily used to cool the engine oil and is usually limited to temperatures below 300° F. The realistic limitations of hydrocarbons with regard to their capability to cool high-speed aircraft or missiles has never been determined. The use of JP7 fuel in the SR71 demonstrated the fact that a hydrocarbon fuel produced from petroleum, could effectively be used in a high-speed aircraft where the fuel would reach temperatures near 600° F. prior to combustion. The Air Force has been investigating the use of hydrocarbons at even higher speeds in both aircraft and missiles over the last 30 years. Techniques for improving the fuel's heat sink capability as the speeds of aircraft increased have been studied. About 25 years ago the USAF began looking at catalytically enhanced endothermic reactions with the dehydrogenation of naphthenes over platinum on alumina catalyst being the most successful. Efforts have been aimed at increasing the activity and the geometric configuration of the catalyst, in order to reduce weight. A total heat sink on the order of 2000 BTUs per pound could be obtained using this approach. However, there are problems in that the catalyst system adds weight and complexity to the aircraft fuel system. For instance, there are limitations on the usable temperatures of the catalyst, and a secondary cooling fluid is needed to transfer heat to the catalyst system. Also, there are pressure drops associated with the efficient use of the catalyst although current research is investigating the coating of catalyst on heat exchange tubes.

SUMMARY OF THE INVENTION

Hydrocarbons, particularly larger hydrocarbon molecules, will thermally crack or pyrolyze as temperatures increase. This cracking or pyrolysis reaction is usually associated with an absorption of heat and if allowed to proceed to completion, the hydrocarbon will crack into smaller molecular weight olefins with substantial amounts of heat being absorbed. These olefins are more reactive than the starting fuel and when injected into a combustor, provide excellent fuel for use in a supersonic combustion ram-jet, which is the air-breathing engine cycle of choice for hypersonic aircraft or missiles. If, however, after cracking the reactive fuel remains within the Fuel system, these products tend to react with each other not only causing an exothermic reverse reaction which degrades the net heat sink available but also products that could cause problems on the heat transfer surfaces, fuel injectors, or clog fuel channels. This is commonly referred to as "coking" by the aviation fuel industry. The present invention uses a diluent which is a relatively more stable hydrocarbon which, when incorporated into the fuel mix, reduces the propensity of the reactive components to combine with themselves to form deleterious compounds.

The reactive hydrocarbon component can be either a normal- or iso-paraffin, since these types of compounds will crack more easily. Typical compounds in this series are n-hexane, n-decane, or larger materials like n-hexadecane. The other component, the diluent, is more stable and will not crack in the same temperature range as the paraffin. It will eventually also crack but in a higher temperature range. Examples of diluents are cyclic hydrocarbons such as naphthenes (cyclic paraffins) or aromatics. It was discovered that materials like methylcyclohexane (a naphthene) function well as diluents in this concept. These diluents are components in the fuel mix and as such are injected into the combustor to supply their energy to the scram-jet or other high-speed engine.

The diluent role is to remain stable when the reactive paraffinic component or components crack without effecting the composition of the diluent. If the diluent is a cyclic paraffin or mixture of cyclic paraffins, it is possible that under the proper conditions, catalytic dehydrogenation could occur at lower temperatures than the thermal cracking or pyrolysis. Under this approach, a diluent component could be produced in-situ and would also be available for higher temperature cracking or pyrolysis. Thus the diluent would be produced in-situ but in a lower temperature range than the one where the pyrolysis occurs. Other in-situ diluent production reactions are possible such as the presence of catalytic cracking catalysts which produce primarily aromatic compounds which could function as diluents for the thermal cracking.

OBJECTS OF THE INVENTION

To increase the cooling ability of hydrocarbon fuels used in high temperature environments.

To provide a lighter weight cooling structure for aircraft and missiles.

To provide a low volume of cooling structure for the amount of heat removed.

To provide an energetic fuel, where the heat absorbed in cooling is released in the oxidation (combustion) process.

To provide a cleaner burning hydrocarbon fuel.

To provide a fast burning hydrocarbon fuel.

To provide a hydrocarbon fuel which is more stable at higher temperatures.

To provide a fuel having easily cracked components which absorb heat and a more stable diluent to prevent the cracked components from recombining and reacting.

DETAILED DESCRIPTION OF THE PREFERRED EMBODIMENT

In most high-speed, hypervelocity, or hypersonic aircraft and missiles, cooling the structure and engines is necessary while keeping the vehicle weight and volume at a minimum. In these systems the fuel will be required to actively cool at least some of vehicle structure and engines. Having a fuel which will absorb considerable heat and not clog or obstruct the cooling channels has been the objective of fuel studies in the recent past. This invention addresses this problem by having a fuel system which is simple, light weight and uses a small volume of fuel to produce the necessary cooling or heat sink enabling very high speeds to be attained. The invention focuses on a fuel composed of two main components. The first component is thermally reactive while the second component is a more thermally stable hydrocarbon or diluent component which reduces the rate at which the pyrolyzed reactive products will recombine before combustion. The ultimate types and concentration of these components will be dictated by the application, i.e., whether it is a missile or an aircraft, and whether it's an accelerator or a cruise vehicle.

Each component of the two component fuel may be made up of any number of constituents. The reactive components over a given temperature range will crack into low molecular weight olefins while the diluent component will remain stable during this thermal cracking or pyrolysis.

The pyrolyzing or reactive component could be a mixture of hydrocarbons that crack or pyrolyze over a temperature range of approximately 900° to 1300° F., depending on pressure and residence time.

The diluent component is preferably a hydrocarbon fuel because of its high energy density, although it could be some other type of stable fuel component such as hydrogen. The diluent could be refinery fraction such as BTX, which is a mixture of benzene, toluene, and xylenes or any of the many other thermally stable hydrocarbons that are produced by the refining and petrochemical industry. The specific type and concentration of the components would be determined by other desired fuel properties such as volatility, freeze point, viscosity and density, etc.

It is important that purity be maintained in the production and storage of hypersonic fuels. The fuel needs to be produced and maintained with very little contamination that might occur in transit or storage. Nonhydrocarbon compounds such as those containing sulfur, nitrogen or oxygen must be removed from the finished fuel for it to function at the higher temperature of pyrolysis. Also, dissolved oxygen may have to be removed from the operational fuel to eliminate oxidation reactions in the liquid fuel.

The diluent component can withstand extreme temperatures above both the critical temperature and critical pressure of the liquid storable fuel components.

The capability of the diluent for maintaining its thermal stability is critical in preventing the reverse reaction of any olefinic compounds that result from the pyrolysis reaction. The cracking of hydrocarbons into low molecular weight olefins like ethylene is endothermic; for instance, a normal paraffin such as n-decane ($C_{10}$) could absorb approximately 1400 BTUs per pound by cracking entirely to $C_2$ and $H_2$. However, the reverse reaction which is exothermic detracts from the benefits of the endothermic forward reaction. The heat sink available is thus reduced and higher molecular weight products cause a degration of the heat transfer process and produces residue which could clog small cooling channels.

The diluent component can be added to the reactive component prior to fueling the vehicle as part of the fuel mixture. The diluent could also be produced in-situ and to that point can be separate from the reactive part. Cyclic naphthenes can be catalytically dehydrogenated at lower temperatures (below 1000° F.). This occurs with a considerable absorption of heat (endothermic) and produces stable compounds as products which can serve as diluents for the thermal cracking later. Methylcyclohexane will catalytically dehydrogenate to produce toluene and hydrogen, both of which are very stable to very high temperatures. After the diluent-producing reaction occurs, the diluent is available to moderate the pyrolysis of the remainder of the fuel mixture. The reactive component would then crack at higher temperatures with the catalytic product acting as a diluent.

The diluent component can be a separate fuel from the reactive component. It would proceed through its catalytic reaction and then after production of the more stable diluent compounds will combine with the reactive component prior to the temperature regime where it cracks. This would require separate tankage but is an option.

There are also mixtures of paraffins such as the paraffinic jet fuel like JP7, which was used in the SR71 aircraft for the last quarter of a century. This fuel is highly paraffinic and could be the reactive component as discussed in this invention. There are also other paraffinic fractions that could also provide the reactive components.

The stable diluent component could also be a mixture of compounds that are stable in terms of the thermal cracking regime of the paraffinic fraction. The diluent keeps the reactive components apart and its own stability plays a key role in increasing the stability of the total fuel. For the diluent to be effective as the pressure gets higher and the lower limit of the temperature range increases the fuels must be characterized not just with regard to heat sink and thermal stability but also with regard to the effect of increased pressure.

The desired characteristics or properties of a fuel will differ depending on the application which will dictate exactly how much heat sink and stability is needed. The concentrations of the components will be dictated by the application of the fuel. In general, the concentration of the reactive material will be somewhere between about 10 wt % up to as much as about 90 wt %.

Increased diluent content will decrease the total heat sink available and increase thermal stability. The type and amount of constituents will also dictate other bulk fuel properties such as volatility, freeze point, low-temperature capability, and viscosity.

During high-temperature pyrolysis the catalytic effect of metals such as copper, nickel and iron, in the cooling channels could enhance the undesirable reverse reactions of the olefins. The catalytic surface produces higher molecular weight materials that could deposit on a heat transfer surface and thus retard heat transfer. Preferably these metal surfaces will be pacified by depositing inert materials such as alumina on the surface.

Conventional aviation gas turbine fuels are middle distillates fractionated from petroleum. For instance, commercial JET-A used by the airlines is normally produced from petroleum but could be produced from any fossil fuel source. These jet fuels are composed of approximately 50% of normal or iso paraffins which are the types of hydrocarbons which crack most readily. The remainder of these fuels are cyclic hydrocarbons, either naphthenes or aromatics which naturally occur in petroleum crude oils. Most jet fuels produced have this general composition. Therefore, within the chemistry of these "natural" fuels is the potential for use at higher speed applications where heat sink and higher thermal stability are required. The jet fuel could be cracked, similar to the earlier instances discussed, and produce considerable heat sink without major modification. The fuels would have to be further refined to remove trace nonhydrocarbon compounds carried over from the refinery process. These fuels should be deoxygenated, particularly if they are to be taken to extremely high temperatures. In terms of high-velocity aircraft that fly in the Mach-4 to -6 regime, conventional fuels could be adapted with sufficient diluent type constituents to meet cooling and stability requirements. Another benefit from upgrading these fuels by removing nonhydrocarbon components is a more environmentally acceptable fuel in terms of exhaust emissions.

Conventional airport facilities could be used in handling these fuels and current aircraft could use this fuel with improved environmental impact and the same fuel would be used in higher speed operations (such as the high-speed civil transport that NASA is studying). The eventual evolution into a hypersonic transport or even interceptor-type aircraft for the military could use the same fuel. Therefore, the diluent requirement could increase usability of conventional types of fuel without segregating fuels for different applications and speed ranges. In other words, in the near future when aircraft will be flying at higher speeds, most of the features in this invention could be applied to a conventional type of fuel where specifications for the fuel would assure the presence of essential reactive and diluent components.

The cooling capability of the hydrocarbon fuel mixtures could also be enhanced through the use of another fuel such as hydrogen ($H_2$). Because of the differences in physical properties, the fuels would be handled separately and would be combined as supercritical or gaseous fluids where the hydrogen would behave as the diluent.

The Applicant's prior patent, U.S. Pat. No. 5,236,152 issued Aug. 17, 1993, titled "COOLING/FUEL SYSTEM FOR HYPERSONIC FLIGHT" is hereby made a part hereof and incorporated herein by reference to show heat sink fuels.

Rockwell International Corporation's copending patent application Ser. No. 08/168,446 filed Dec. 15, 1993, titled "SCRAM-STAGE MISSILE" is hereby made a part hereof and incorporated herein by reference to show vehicle designs which could benefit from the fuel in this application.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A multiconstituent endothermic cooling anticoking liquid fuel for a vehicle comprising:

at least one fuel component selected from the group consisting of normal paraffins and iso-paraffins, which pyrolyzes in a temperature range of from about 900° F. to about 1300° F. providing cooling for the vehicle and;

at least one fuel component selected from the group consisting of cyclic hydrocarbons, which acts as a stable diluent in the temperature range of from about 900° F. to about 1300° F., retarding exothermic back reactions of the pyrolyzed fuel components and reducing coking.

2. A multiconstituent endothermic cooling anticoking liquid fuel for a vehicle as in claim 1 wherein, at least one fuel component undergoes the in in-situ production of diluent.

3. A multiconstituent endothermic cooling anticoking liquid fuel for a vehicle as in claim 1 wherein, the fuel and diluent components are tanked separately and, at least one diluent component undergoes in-situ catalytic production of diluent and the resulting stable products are commingled prior to pyrolysis of the fuel.

4. A multiconstituent endothermic cooling anticoking liquid fuel for a vehicle as in claim 1 wherein, the normal paraffins and iso-paraffins are selected from the group consisting of JP-7, JP-8, hexane, decane and hexadecane.

5. A multiconstituent endothermic cooling anticoking liquid fuel for a vehicle as in claim 1 wherein, the cyclic hydrocarbons are selected from the group consisting of methylcyclohexane, toluene, tetralin, and tetrahydrodicyclopentadine (JP-10).

6. A multiconstituent endothermic cooling anticoking liquid fuel for a vehicle as in claim 1 wherein, the fuel components are subjected to a pressure range of from about 14.7 to about 2000 psi.

7. A multiconstituent endothermic cooling anticoking liquid fuel for a vehicle as in claim 1 wherein, fuel component which pyrolyzes is from about 10 weight % to about 90 weight % and the fuel component which acts as a diluent making up the remainder of the fuel mixture.

8. A multiconstituent endothermic cooling anticoking liquid fuel for a vehicle as in claim 1 wherein, the fuel component which pyrolyzes, cracks into ethylene type products which easily and quickly mix oxidizers to burn well.

9. A multiconstituent endothermic cooling anticoking liquid fuel for a vehicle as in claim 1 wherein, the multiconstituent liquid fuel is passed through a cooling channel having a coating to prevent coke-producing catalytic reactions.

10. A multiconstituent endothermic cooling anticoking liquid fuel for a vehicle as in claim 1 wherein, the fuel components are about 50% normal and iso paraffins and about 50% selected from the group consisting of naphthenes and aromatics.

11. A method of cooling a vehicle with a multiconstituent liquid fuel which comprises:

mixing at least one fuel component selected from the group consisting of normal paraffins and iso-paraffins, which pyrolyzes in a temperature range of from about 900° F. to about 1300° F. and;

at least one fuel component selected from the group consisting of cyclic hydrocarbons, which acts as a stable diluent in a temperature range of from about 900° F. to about 1300° F., pyrolyzing the mixed fuel components, thereby endothermically providing for cooling an engine or a vehicle structure with the stable diluent retarding back reactions of reactive pyrolyzed products.

12. A method of cooling a vehicle with a multiconstituent liquid fuel as in claim 11 wherein, at least one fuel component undergoes the in in-situ production of diluent.

13. A method of cooling a vehicle with a multiconstituent liquid fuel as in claim 11 wherein, the fuel component selected from the group consisting of normal parafins, which pyrolyzes in a temperature range of from about 900° F. to about 1300° F. and the fuel component selected from the group consisting of cyclic hydrocarbons, which acts as a stable diluent in a temperature range of from about 900° F. to about 1300° F. are tanked separately and, at least one fuel component selected from the group consisting of cyclic hydrocarbons, which acts as a stable diluent in a temperature range of from about 900° F. to about 1300° F. undergoes in-situ catalytic production of diluent and the resulting stable products are commingled prior to pyrolysis of the fuel.

14. A method of cooling a vehicle with a multiconstituent liquid fuel as in claim 11 wherein, the normal paraffins and iso-paraffins are selected from the group consisting of JP-7, JP-8, hexane, decane and hexadecane.

15. A method of cooling a vehicle with a multiconstituent liquid fuel as in claim 11 wherein, the cyclic hydrocarbons are selected from the group consisting of methylcyclohexane, toluene, tetralin, and tetrahydrodicyclopentadine (JP-10).

16. A method of cooling a vehicle with a multiconstituent liquid fuel as in claim 11 wherein, the fuel components are subjected to a pressure range of from about 14.7 to about 2000 psi.

17. A method of cooling a vehicle with a multiconstituent liquid fuel as in claim 11 wherein, fuel component which pyrolyzes is from about 10 weight % to about 90 weight % and the fuel component which act as a diluent making up the remainder of the fuel mixture.

18. A method of cooling a vehicle with a multiconstituent liquid fuel as in claim 11 wherein, the fuel component which pyrolyzes, cracks into ethylene type products which easily and quickly mix oxidizers to burn well.

19. A method of cooling a vehicle with a multiconstituent liquid fuel as in claim 11 wherein, the multiconstituent liquid fuel is passed through a cooling channel having a coating to prevent coke-producing catalytic reactions.

20. A method of cooling a vehicle with a multiconstituent liquid fuel as in claim 11 wherein, the fuel components are about 50% normal and iso paraffins and about 50% selected from the group consisting of naphthenes and aromatics.

* * * * *